US011258165B2

(12) United States Patent
We et al.

(10) Patent No.: US 11,258,165 B2
(45) Date of Patent: Feb. 22, 2022

(54) ASYMMETRIC ANTENNA STRUCTURE

(71) Applicant: QUALCOMM Incorporated, San Diego, CA (US)

(72) Inventors: Hong Bok We, San Diego, CA (US); Chin-Kwan Kim, San Diego, CA (US); Jaehyun Yeon, San Diego, CA (US); Suhyung Hwang, Rancho Mission Viejo, CA (US)

(73) Assignee: QUALCOMM Incorporated, San Diego, CA (US)

( * ) Notice: Subject to any disclaimer, the term of this patent is extended or adjusted under 35 U.S.C. 154(b) by 214 days.

(21) Appl. No.: 16/236,726

(22) Filed: Dec. 31, 2018

(65) Prior Publication Data

US 2020/0212545 A1 Jul. 2, 2020

(51) Int. Cl.

| | |
|---|---|
| ***H01Q 1/38*** | (2006.01) |
| ***H01Q 1/24*** | (2006.01) |
| ***H01Q 9/12*** | (2006.01) |
| ***H01Q 1/08*** | (2006.01) |
| *H01Q 5/364* | (2015.01) |

(52) U.S. Cl.

CPC ..... *H01Q 1/246* (2013.01); *H01Q 1/085* (2013.01); *H01Q 9/12* (2013.01); *H01Q 5/364* (2015.01)

(58) Field of Classification Search

CPC ..... H01Q 1/246; H01Q 9/12; H01Q 1/085; H01Q 5/364; H01Q 1/38; H01Q 1/241; H01Q 1/273; H01Q 11/14; H01Q 1/521; H01Q 21/061; H01Q 21/065; H01Q 3/01

See application file for complete search history.

(56) References Cited

U.S. PATENT DOCUMENTS

| | | | | |
|---|---|---|---|---|
| 7,265,719 | B1 * | 9/2007 | Moosbrugger | H01Q 21/0025 343/700 MS |
| 10,686,362 | B2 * | 6/2020 | Dusmez | H02M 7/217 |
| 2003/0054855 | A1 * | 3/2003 | Kojola | H01Q 1/38 455/550.1 |
| 2012/0325524 | A1 * | 12/2012 | Naganuma | H05K 3/4691 174/254 |
| 2014/0354484 | A1 * | 12/2014 | Kashiwagi | H01Q 5/335 343/700 MS |
| 2018/0026341 | A1 * | 1/2018 | Mow | H04B 10/90 343/702 |
| 2019/0372229 | A1 * | 12/2019 | Dalmia | H01Q 9/0407 |
| 2020/0021015 | A1 * | 1/2020 | Yun | H01Q 25/00 |
| 2020/0212545 | A1 * | 7/2020 | We | H01Q 1/1235 |
| 2020/0335847 | A1 * | 10/2020 | Saily | H01Q 21/08 |

* cited by examiner

*Primary Examiner* — David E Lotter

(74) *Attorney, Agent, or Firm* — Patterson & Sheridan, L.L.P.

(57) ABSTRACT

Certain aspects of the present disclosure provide an asymmetric antenna structure. An example antenna device generally includes a first antenna element, a second antenna element, and a flexible coupling element asymmetrically positioned between surfaces of the first and second antenna elements and electrically coupling the first antenna element to the second antenna element.

8 Claims, 10 Drawing Sheets

ASYMMETRIC ANTENNA STRUCTURE

BACKGROUND

Field of the Disclosure

Aspects of the present disclosure relate to wireless communications, and more particularly, to an antenna device having a flexible coupling element asymmetrically positioned between surfaces of first and second antenna elements.

Description of Related Art

Wireless communication networks are widely deployed to provide various communication services such as telephony, video, data, messaging, broadcasts, and so on. Such networks, which are usually multiple access networks, support communications for multiple users by sharing the available network resources. A wireless communication network may include a number of base stations that can support communication for a number of user equipments. A user equipment (UE) may communicate with a base station (BS) via a downlink and an uplink. The UE and/or BS may include a radio frequency front-end (RFFE) for transmitting and/or receiving radio frequency (RF) signals, and the RFFE may include an antenna device.

BRIEF SUMMARY

The systems, methods, and devices of the disclosure each have several aspects, no single one of which is solely responsible for its desirable attributes. Without limiting the scope of this disclosure as expressed by the claims which follow, some features will now be discussed briefly. After considering this discussion, and particularly after reading the section entitled "Detailed Description" one will understand how the features of this disclosure provide advantages that include an improved antenna device for mmWave applications, for example.

Certain aspects provide an antenna device. The antenna device generally includes a first antenna element, a second antenna element, and a flexible coupling element asymmetrically positioned between surfaces of the first and second antenna elements and electrically coupling the first antenna element to the second antenna element.

Certain aspects provide a method of fabricating an antenna device. The method generally includes forming at least one flexible coupling layer disposed above a substrate layer and forming a conductive layer disposed above the at least one flexible coupling layer. The method also includes cutting a first cavity in at least the conductive layer to define a first antenna element region on one side of the first cavity and a second antenna element region on another side of the first cavity and cutting a second cavity in at least the substrate layer between the first antenna element region and the second antenna element region, such that the first cavity and second cavity have different depths and the at least one flexible coupling layer is asymmetrically positioned between surfaces of the first and second antenna element regions.

To the accomplishment of the foregoing and related ends, the one or more aspects comprise the features hereinafter fully described and particularly pointed out in the claims. The following description and the appended drawings set forth in detail certain illustrative features of the one or more aspects. These features are indicative, however, of but a few of the various ways in which the principles of various aspects may be employed.

BRIEF DESCRIPTION OF THE DRAWINGS

So that the manner in which the above-recited features of the present disclosure can be understood in detail, a more particular description, briefly summarized above, may be had by reference to aspects, some of which are illustrated in the drawings. It is to be noted, however, that the appended drawings illustrate only certain typical aspects of this disclosure and are therefore not to be considered limiting of its scope, for the description may admit to other equally effective aspects.

To facilitate understanding, identical reference numerals have been used, where possible, to designate identical elements that are common to the figures. It is contemplated that elements disclosed in one aspect may be beneficially utilized on other aspects without specific recitation.

DETAILED DESCRIPTION

Figure 1:
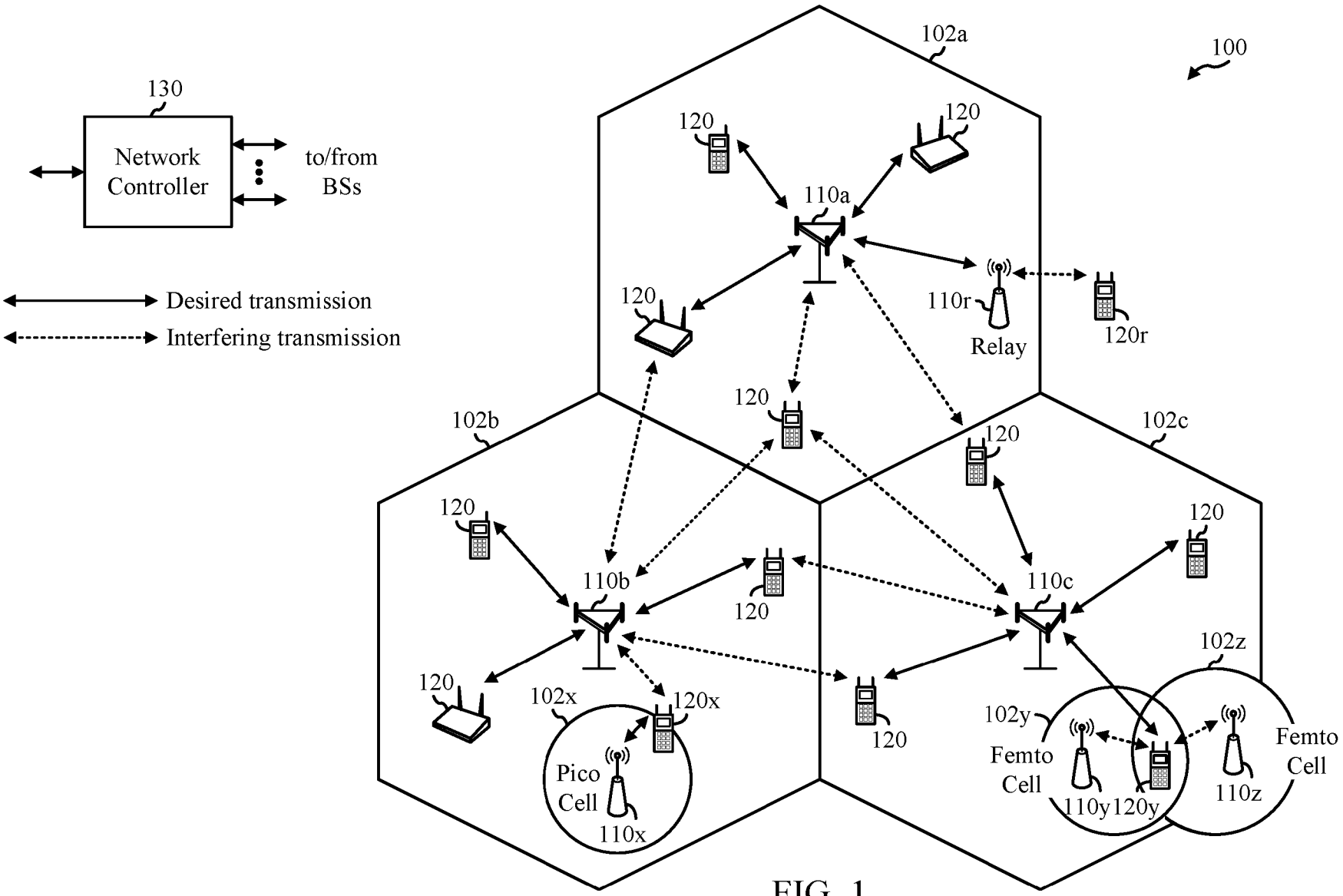
FIG. 1 is a block diagram conceptually illustrating an example telecommunications system, in accordance with certain aspects of the present disclosure.

Aspects of the present disclosure provide antenna devices and methods for fabricating an antenna device for mmWave applications, for example.

The following description provides examples, and is not limiting of the scope, applicability, or examples set forth in the claims. Changes may be made in the function and arrangement of elements discussed without departing from the scope of the disclosure. Various examples may omit, substitute, or add various procedures or components as appropriate. For instance, the methods described may be performed in an order different from that described, and various steps may be added, omitted, or combined. Also, features described with respect to some examples may be combined in some other examples. For example, an apparatus may be implemented or a method may be practiced using any number of the aspects set forth herein. In addition, the scope of the disclosure is intended to cover such an apparatus or method which is practiced using other structure, functionality, or structure and functionality in addition to, or other than, the various aspects of the disclosure set forth herein. It should be understood that any aspect of the disclosure disclosed herein may be embodied by one or more elements of a claim. The word "exemplary" is used herein to mean "serving as an example, instance, or illustration." Any aspect described herein as "exemplary" is not necessarily to be construed as preferred or advantageous over other aspects.

The techniques described herein may be used for various wireless communication technologies, such as LTE, CDMA, TDMA, FDMA, OFDMA, SC-FDMA, and other networks. The terms "network" and "system" are often used interchangeably. A CDMA network may implement a radio technology such as Universal Terrestrial Radio Access (UTRA), cdma2000, etc. UTRA includes Wideband CDMA (WCDMA) and other variants of CDMA. cdma2000 covers IS-2000, IS-95 and IS-856 standards. A TDMA network may implement a radio technology such as Global System for Mobile Communications (GSM). An OFDMA network may implement a radio technology such as NR (e.g. 5G RAT), Evolved UTRA (E-UTRA), Ultra Mobile Broadband (UMB), IEEE 802.11 (Wi-Fi), IEEE 802.16 (WiMAX), IEEE 802.20, Flash-OFDMA, etc. UTRA and E-UTRA are part of Universal Mobile Telecommunication System (UMTS).

New Radio (NR) is an emerging wireless communications technology under development in conjunction with the 5G Technology Forum (5GTF). 3GPP Long Term Evolution (LTE) and LTE-Advanced (LTE-A) are releases of UMTS that use E-UTRA. UTRA, E-UTRA, UMTS, LTE, LTE-A, and GSM are described in documents from an organization named "3rd Generation Partnership Project" (3GPP). cdma2000 and UMB are described in documents from an organization named "3rd Generation Partnership Project 2" (3GPP2). The techniques described herein may be used for the wireless networks and radio technologies mentioned above, as well as other wireless networks and radio technologies. For clarity, while aspects may be described herein using terminology commonly associated with 3G and/or 4G wireless technologies, aspects of the present disclosure can be applied in other generation-based communication systems, such as 5G and later, including NR technologies.

NR access (e.g., 5G technology) may support various wireless communication services, such as enhanced mobile broadband (eMBB) targeting wide bandwidth (e.g., 80 MHz or beyond), millimeter wave (mmW) targeting high carrier frequency (e.g., 25 GHz or beyond), massive machine type communications MTC (mMTC) targeting non-backward compatible MTC techniques, and/or mission critical targeting ultra-reliable low-latency communications (URLLC). These services may include latency and reliability requirements. These services may also have different transmission time intervals (TTI) to meet respective quality of service (QoS) requirements. In addition, these services may co-exist in the same subframe.

Example Wireless Communications System

FIG. 1 illustrates an example wireless communication network 100 in which aspects of the present disclosure may be performed. For example, the wireless communication network 100 may be a New Radio (NR) or 5G network employing the antenna device described herein for wireless communications.

As illustrated in FIG. 1, the wireless network 100 may include a number of base stations (BSs) 110 and other network entities. A BS may be a station that communicates with user equipment (UEs) 120. Each BS 110 may provide communication coverage for a particular geographic area. In 3GPP, the term "cell" can refer to a coverage area of a Node B (NB) and/or a Node B subsystem serving this coverage area, depending on the context in which the term is used. In NR systems, the term "cell" and next generation NodeB (gNB), new radio base station (NR BS), 5G NB, access point (AP), or transmission reception point (TRP) may be interchangeable. In some examples, a cell may not necessarily be stationary, and the geographic area of the cell may move according to the location of a mobile BS. In some examples, the base stations may be interconnected to one another and/or to one or more other base stations or network nodes (not shown) in wireless communication network 100 through various types of backhaul interfaces, such as a direct physical connection, a wireless connection, a virtual network, or the like, using any suitable transport network.

In general, any number of wireless networks may be deployed in a given geographic area. Each wireless network may support a particular radio access technology (RAT) and may operate on one or more frequencies. A RAT may also be referred to as a radio technology, an air interface, etc. A frequency may also be referred to as a carrier, a subcarrier, a frequency channel, a tone, a subband, etc. Each frequency may support a single RAT in a given geographic area in order to avoid interference between wireless networks of different RATs. In some cases, NR or 5G RAT networks may be deployed.

A base station (BS) may provide communication coverage for a macro cell, a pico cell, a femto cell, and/or other types of cells. A macro cell may cover a relatively large geographic area (e.g., several kilometers in radius) and may allow unrestricted access by UEs with service subscription. A pico cell may cover a relatively small geographic area and may allow unrestricted access by UEs with service subscription. A femto cell may cover a relatively small geographic area (e.g., a home) and may allow restricted access by UEs having an association with the femto cell (e.g., UEs in a Closed Subscriber Group (CSG), UEs for users in the home, etc.). A BS for a macro cell may be referred to as a macro BS. A BS for a pico cell may be referred to as a pico BS. A BS for a femto cell may be referred to as a femto BS or a home BS. In the example shown in FIG. 1, the BSs 110*a*, 110*b*, and 110*c* may be macro BSs for the macro cells 102*a*, 102*b*, and 102*c*, respectively. The BS 110*x* may be a pico BS for a pico cell 102*x*. The BSs 110*y* and 110*z* may be femto BSs for the femto cells 102*y* and 102*z*, respectively. A BS may support one or multiple (e.g., three) cells.

Wireless communication network 100 may also include relay stations. A relay station is a station that receives a transmission of data and/or other information from an upstream station (e.g., a BS or a UE) and sends a transmission of the data and/or other information to a downstream station (e.g., a UE or a BS). A relay station may also be a UE that relays transmissions for other UEs. In the example shown in FIG. 1, a relay station 110*r* may communicate with the BS 110*a* and a UE 120*r* in order to facilitate communication between the BS 110*a* and the UE 120*r*. A relay station may also be referred to as a relay BS, a relay, etc.

Wireless network 100 may be a heterogeneous network that includes BSs of different types, e.g., macro BS, pico BS, femto BS, relays, etc. These different types of BSs may have different transmit power levels, different coverage areas, and different impact on interference in the wireless network 100. For example, macro BSs may have a high transmit power level (e.g., 20 watts (W)), whereas pico BSs, femto BSs, and relays may have a lower transmit power level (e.g., 1 W).

Wireless communication network 100 may support synchronous or asynchronous operation. For synchronous operation, the BSs may have similar frame timing, and transmissions from different BSs may be approximately aligned in time. For asynchronous operation, the BSs may have different frame timing, and transmissions from different BSs may not be aligned in time. The techniques described herein may be used for both synchronous and asynchronous operation.

A network controller 130 may couple to a set of BSs and provide coordination and control for these BSs. The network controller 130 may communicate with the BSs 110 via a backhaul. The BSs 110 may also communicate with one another (e.g., directly or indirectly) via wireless or wireline backhaul.

The UEs 120 (e.g., 120*x*, 120*y*, etc.) may be dispersed throughout the wireless network 100, and each UE may be stationary or mobile. A UE may also be referred to as a mobile station, a terminal, an access terminal, a subscriber unit, a station, a Customer Premises Equipment (CPE), a cellular phone, a smart phone, a personal digital assistant (PDA), a wireless modem, a wireless communication device, a handheld device, a laptop computer, a cordless phone, a wireless local loop (WLL) station, a tablet (computer), a camera, a gaming device, a netbook, a smartbook, an ultrabook, an appliance, a medical device or medical equipment, a biometric sensor/device, a wearable device such as a smart watch, smart clothing, smart glasses, a smart wrist band, smart jewelry (e.g., a smart ring, a smart bracelet, etc.), an entertainment device (e.g., a music device, a video device, a satellite radio, etc.), a vehicular component or sensor, a smart meter/sensor, industrial manufacturing equipment, a global positioning system (GPS) device, or any other suitable device that is configured to communicate via a wireless or wired medium. Some UEs may be considered machine-type communication (MTC) devices or evolved MTC (eMTC) devices. MTC and eMTC UEs include, for example, robots, drones, remote devices, sensors, meters, monitors, location tags, etc., that may communicate with a BS, another device (e.g., remote device), or some other entity. A wireless node may provide, for example, connectivity for or to a network (e.g., a wide area network such as Internet or a cellular network) via a wired or wireless communication link. Some UEs may be considered Internet-of-Things (IoT) devices, which may be narrowband IoT (NB-IoT) devices.

Certain wireless networks (e.g., LTE) utilize orthogonal frequency division multiplexing (OFDM) on the downlink and single-carrier frequency division multiplexing (SC-FDM) on the uplink. OFDM and SC-FDM partition the system bandwidth into multiple (K) orthogonal subcarriers, which are also commonly referred to as tones, bins, etc. Each subcarrier may be modulated with data. In general, modulation symbols are sent in the frequency domain with OFDM and in the time domain with SC-FDM. The spacing between adjacent subcarriers may be fixed, and the total number of subcarriers (K) may be dependent on the system bandwidth. For example, the spacing of the subcarriers may be 15 kHz and the minimum resource allocation (called a "resource block" (RB)) may be 12 subcarriers (or 180 kHz). Consequently, the nominal fast Fourier Transfer (FFT) size may be equal to 128, 256, 512, 1024, or 2048 for system bandwidth of 1.25, 2.5, 5, 10, or 20 megahertz (MHz), respectively. The system bandwidth may also be partitioned into subbands. For example, a subband may cover 1.8 MHz (e.g., 6 resource blocks), and there may be 1, 2, 4, 8, or 16 subbands for system bandwidth of 1.25, 2.5, 5, 10, or 20 MHz, respectively.

While aspects of the examples described herein may be associated with LTE technologies, aspects of the present disclosure may be applicable with other wireless communications systems, such as NR. NR may utilize OFDM with a cyclic prefix (CP) on the uplink and downlink and include support for half-duplex operation using time-division duplexing (TDD). Beamforming may be supported, and beam direction may be dynamically configured. MIMO transmissions with precoding may also be supported. MIMO configurations in the DL may support up to 8 transmit antennas with multi-layer DL transmissions up to 8 streams and up to 2 streams per UE. Multi-layer transmissions with up to 2 streams per UE may be supported. Aggregation of multiple cells may be supported with up to 8 serving cells.

A scheduling entity (e.g., a base station) allocates resources for communication among some or all devices and equipment within its service area or cell. The scheduling entity may be responsible for scheduling, assigning, reconfiguring, and releasing resources for one or more subordinate entities. That is, for scheduled communication, subordinate entities utilize resources allocated by the scheduling entity. Base stations are not the only entities that may function as a scheduling entity. In some examples, a UE may function as a scheduling entity and may schedule resources for one or more subordinate entities (e.g., one or more other UEs), and the other UEs may utilize the resources scheduled by the UE for wireless communication. In some examples, a UE may function as a scheduling entity in a peer-to-peer (P2P) network, and/or in a mesh network. In a mesh network example, UEs may communicate directly with one another in addition to communicating with a scheduling entity.

In FIG. 1, a solid line with double arrows indicates desired transmissions between a UE and a serving BS, which is a BS designated to serve the UE on the downlink and/or uplink. A finely dashed line with double arrows indicates interfering transmissions between a UE and a BS.

Figure 2:
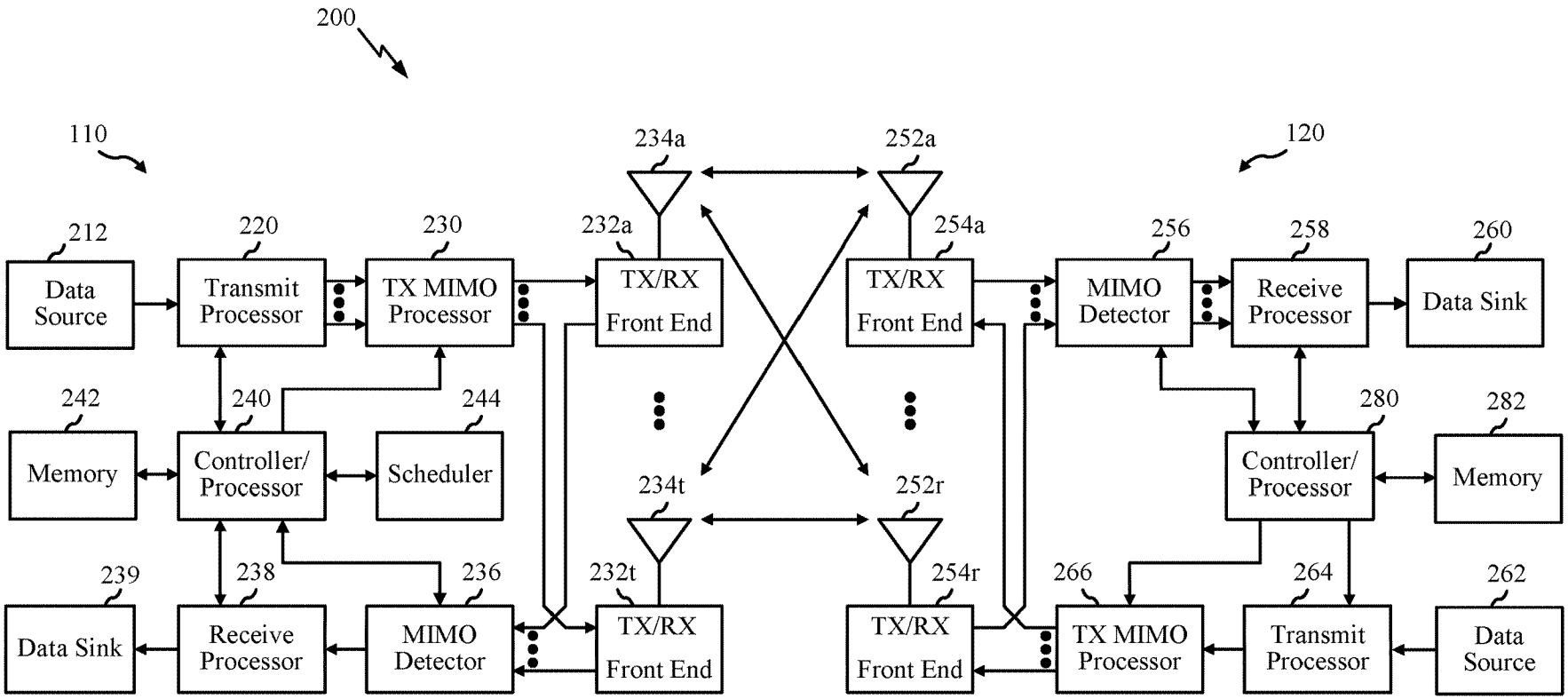
FIG. 2 is a block diagram conceptually illustrating a design of an example base station (BS) and user equipment (UE), in accordance with certain aspects of the present disclosure.

FIG. 2 illustrates example components of BS 110 and UE 120 (as depicted in FIG. 1), in which aspects of the present disclosure may be implemented. For example, antennas 252 of the UE 120 and/or antennas 234 of the BS 110 may be implemented by an antenna device as described herein.

At the BS 110, a transmit processor 220 may receive data from a data source 212 and control information from a controller/processor 240. The control information may be for the physical broadcast channel (PBCH), physical control format indicator channel (PCFICH), physical hybrid ARQ indicator channel (PHICH), physical downlink control channel (PDCCH), group common PDCCH (GC PDCCH), etc. The data may be for the physical downlink shared channel (PDSCH), etc. The processor 220 may process (e.g., encode and symbol map) the data and control information to obtain data symbols and control symbols, respectively. The processor 220 may also generate reference symbols, e.g., for the primary synchronization signal (PSS), secondary synchronization signal (SSS), and cell-specific reference signal (CRS). A transmit (TX) multiple-input multiple-output (MIMO) processor 230 may perform spatial processing (e.g., precoding) on the data symbols, the control symbols, and/or the reference symbols, if applicable, and may provide output symbol streams to the transmit (TX) front end circuits 232*a* through 232*t*. Each TX front end circuit 232 may process a respective output symbol stream (e.g., for OFDM, etc.) to obtain an output sample stream. Each TX front end circuit may further process (e.g., convert to analog, amplify, filter, and upconvert) the output sample stream to obtain a downlink signal. Downlink signals from TX front end circuits 232*a* through 232*t* may be transmitted via the antennas 234*a* through 234*t*, respectively.

At the UE 120, the antennas 252*a* through 252*r* may receive the downlink signals from the BS 110 and may provide received signals to the receive (RX) front end circuits 254*a* through 254*r*, respectively. Each RX front end circuit 254 may condition (e.g., filter, amplify, downconvert, and digitize) a respective received signal to obtain input samples. Each RX front end circuit may further process the input samples (e.g., for OFDM, etc.) to obtain received symbols. A MIMO detector 256 may obtain received symbols from all the RX front end circuits 254*a* through 254*r*, perform MIMO detection on the received symbols if applicable, and provide detected symbols. A receive processor 258 may process (e.g., demodulate, deinterleave, and decode) the detected symbols, provide decoded data for the UE 120 to a data sink 260, and provide decoded control information to a controller/processor 280.

On the uplink, at UE 120, a transmit processor 264 may receive and process data (e.g., for the physical uplink shared channel (PUSCH)) from a data source 262 and control information (e.g., for the physical uplink control channel (PUCCH) from the controller/processor 280. The transmit processor 264 may also generate reference symbols for a reference signal (e.g., for the sounding reference signal (SRS)). The symbols from the transmit processor 264 may be precoded by a TX MIMO processor 266 if applicable, further processed by the TX/RX front end circuits 254*a* through 254*r* (e.g., for SC-FDM, etc.), and transmitted to the BS 110. At the BS 110, the uplink signals from the UE 120 may be received by the antennas 234, processed by the TX/RX front end circuits 232, detected by a MIMO detector 236 if applicable, and further processed by a receive processor 238 to obtain decoded data and control information sent by the UE 120. The receive processor 238 may provide the decoded data to a data sink 239 and the decoded control information to the controller/processor 240.

The controllers/processors 240 and 280 may direct the operation at the BS 110 and the UE 120, respectively. The processor 240 and/or other processors and modules at the BS 110 may perform or direct the execution of processes for the techniques described herein. The memories 242 and 282 may store data and program codes for BS 110 and UE 120, respectively. A scheduler 244 may schedule UEs for data transmission on the downlink and/or uplink.

Figure 3:
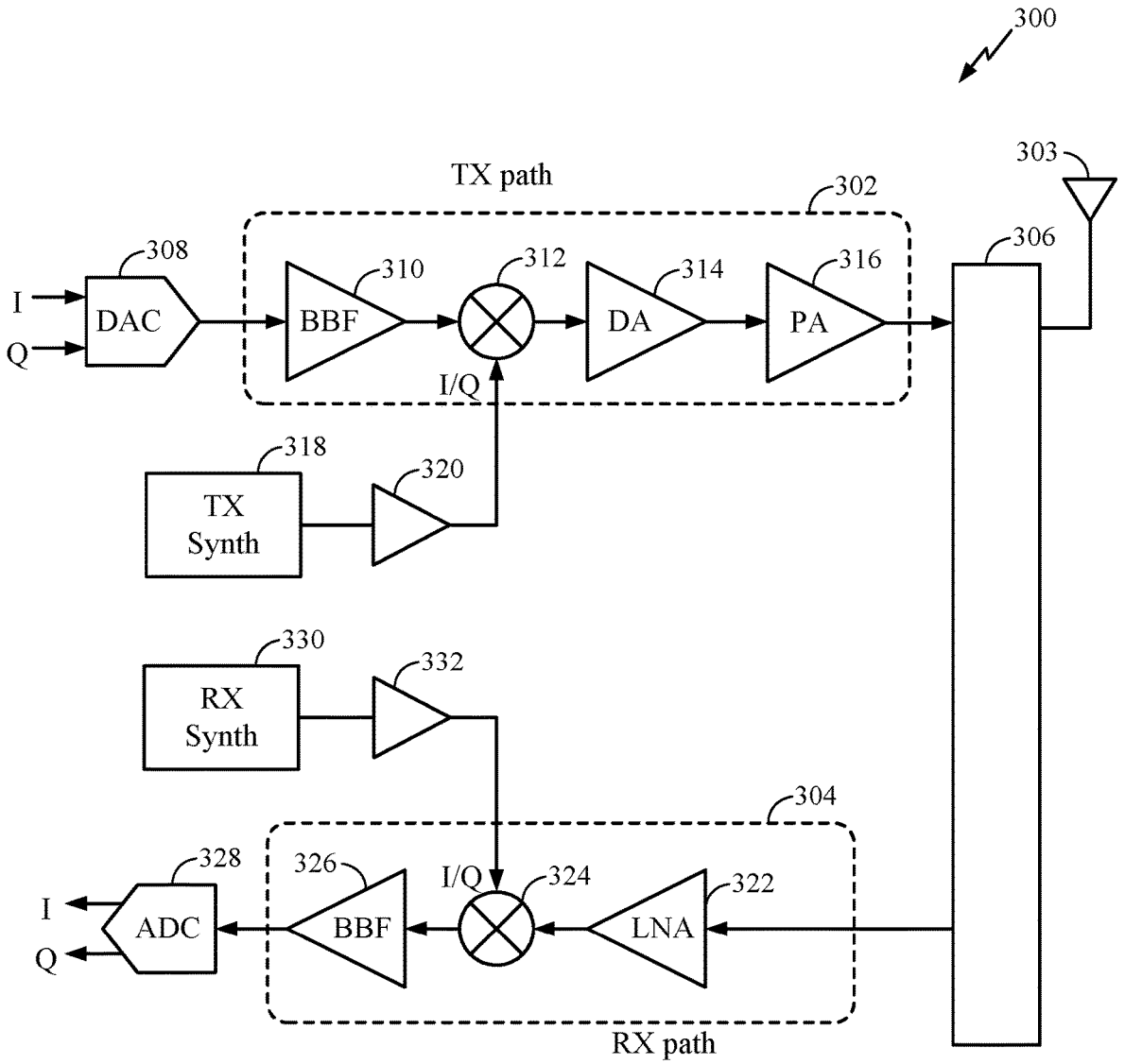
FIG. 3 is a block diagram showing an example transceiver front end, in accordance with certain aspects of the present disclosure.

FIG. 3 is a block diagram of an example transceiver front end 300, such as TX/RX front end circuits 232, 254 in FIG. 2, in which aspects of the present disclosure may be practiced. The transceiver front end 300 includes at least one transmit (TX) path 302 (also known as a transmit chain) for transmitting signals via one or more antennas and at least one receive (RX) path 304 (also known as a receive chain) for receiving signals via the antennas. When the TX path 302 and the RX path 304 share an antenna 303, the paths may be connected with the antenna via an interface 306, which may include any of various suitable RF devices, such as a duplexer, a switch, a diplexer, and the like.

Receiving in-phase (I) or quadrature (Q) baseband analog signals from a digital-to-analog converter (DAC) 308, the TX path 302 may include a baseband filter (BBF) 310, a mixer 312, a driver amplifier (DA) 314, and a power amplifier (PA) 316. The BBF 310, the mixer 312, and the DA 314 may be included in a radio frequency integrated circuit (RFIC), while the PA 316 may be included in the RFIC or external to the RFIC. The BBF 310 filters the baseband signals received from the DAC 308, and the mixer 312 mixes the filtered baseband signals with a transmit local oscillator (LO) signal to convert the baseband signal of interest to a different frequency (e.g., upconvert from baseband to RF). This frequency conversion process produces the sum and difference frequencies between the LO frequency and the frequencies of the baseband signal of interest. The sum and difference frequencies are referred to as the beat frequencies. The beat frequencies are typically in the RF range, such that the signals output by the mixer 312 are typically RF signals, which may be amplified by the DA 314 and/or by the PA 316 before transmission by the antenna 303.

The RX path 304 may include a low noise amplifier (LNA) 322, a mixer 324, and a baseband filter (BBF) 326. The LNA 322, the mixer 324, and the BBF 326 may be included in a radio frequency integrated circuit (RFIC), which may or may not be the same RFIC that includes the TX path components. RF signals received via the antenna 303 may be amplified by the LNA 322, and the mixer 324 mixes the amplified RF signals with a receive local oscillator (LO) signal to convert the RF signal of interest to a different baseband frequency (i.e., downconvert). The baseband signals output by the mixer 324 may be filtered by the BBF 326 before being converted by an analog-to-digital converter (ADC) 328 to digital I or Q signals for digital signal processing.

While it is desirable for the output of an LO to remain stable in frequency, tuning to different frequencies indicates using a variable-frequency oscillator, which involves compromises between stability and tunability. Contemporary systems may employ frequency synthesizers with a voltage-controlled oscillator (VCO) to generate a stable, tunable LO with a particular tuning range. Thus, the transmit LO may be produced by a TX frequency synthesizer 318, which may be buffered or amplified by amplifier 320 before being mixed with the baseband signals in the mixer 312. Similarly, the receive LO may be produced by an RX frequency synthesizer 330, which may be buffered or amplified by amplifier 332 before being mixed with the RF signals in the mixer 324.

Example Asymmetric Antenna Structure

Fifth generation cellular networks, commonly referred to as 5G NR, are expected to operate at sub-6 GHz frequencies and frequencies in the range of 24.25 to 86 GHz, with the lower 19.25 GHz (24.25 to 43.5 GHz) more likely to be used for mobile devices. For ease of reference, the waves in this range will be referred to as mmWaves. Conventional antenna devices (e.g., antenna modules that have a flex substrate or rigid piece of printed circuit board electrically coupling antenna elements) used for wireless communications at frequencies below mmWaves have several key issues. These conventional antenna devices have limitations for mmWave applications, such as 5G NR. For instance, these antenna devices do not provide the various antenna coverage designs used in mmWave applications. Such conventional antenna devices use varying antenna chip mounting techniques and have design rule limitations.

Certain aspects of the present disclosure provide an antenna device that combines design rules from various technologies. For instance, the antenna device may use rigid substrate technology, package technology, and/or radio frequency technology. The antenna device may also have a flexible coupling element asymmetrically positioned between surfaces of antenna elements as further described herein. The asymmetric position of the flexible coupling element may enable a feeding layer location that improves the performance of the antenna device for mmWave applications. The flexible coupling element may also enable antenna elements to have different orientations and/or polarities.

Figure 4A:
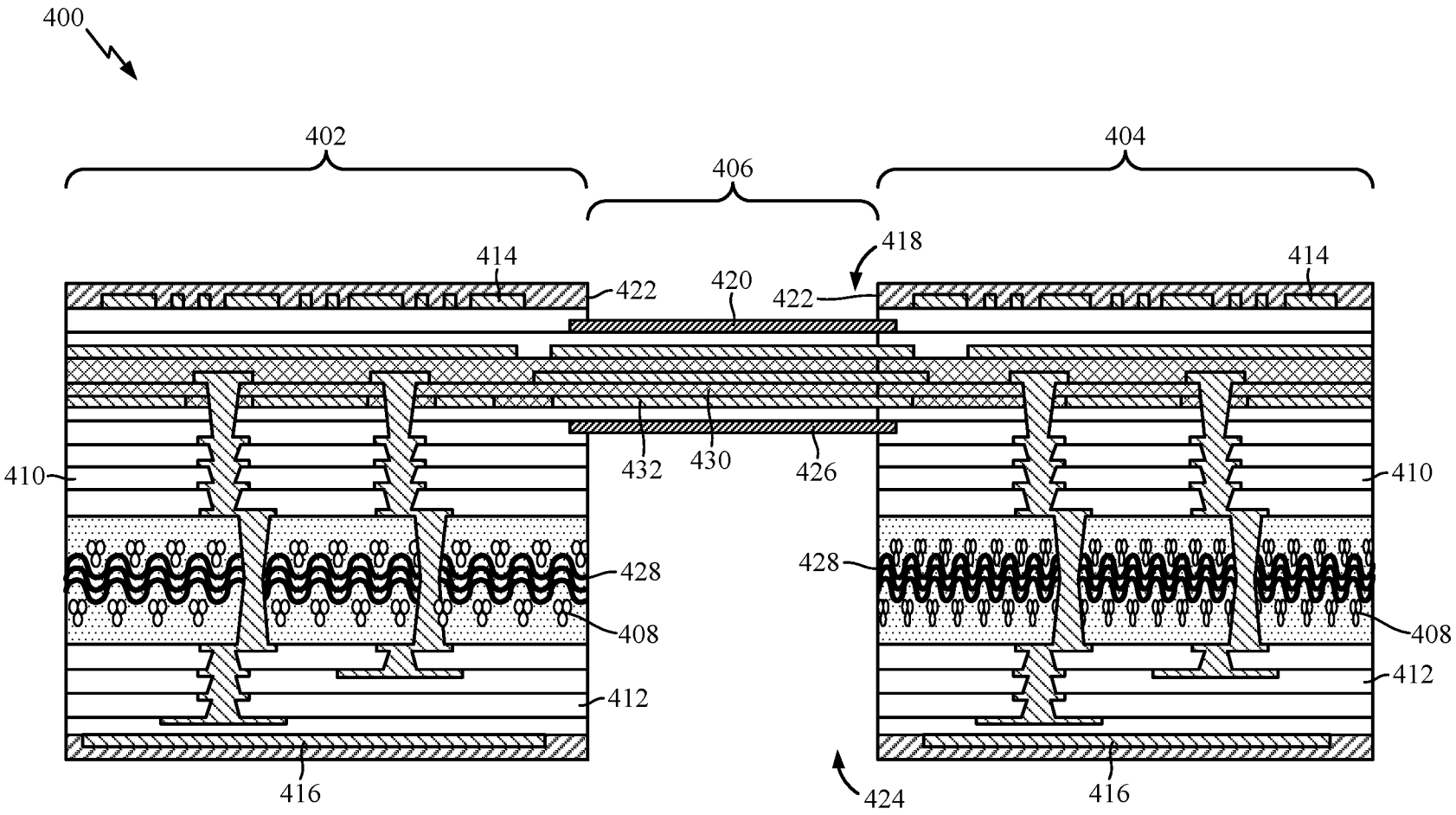
FIG. 4A is a cross-sectional view of an example antenna device, in accordance with certain aspects of the present disclosure.

FIG. 4A illustrates a cross-sectional view of an example antenna device 400, in accordance with certain aspects of the present disclosure. The antenna device 400 includes a first antenna element 402, a second antenna element 404, and a flexible coupling element 406. As shown, each of the first and second antenna elements 402, 404 includes a rigid substrate material 408 having a rigid core. One or more first laminate layers 410 are disposed above the rigid substrate material 408, and one or more second laminate layers 412 are disposed below the rigid substrate material 408. Each of the first and second antenna elements 402, 404 may include a first electrically conductive layer 414 disposed above the rigid substrate material 408 and a second electrically conductive layer 416 disposed below the rigid substrate material 408. The first conductive layer 414 and/or the second conductive layer 416 may serve as a ground plane, antenna coil, or an RF reflector, for example. For instance, the first conductive layer 414 disposed above the rigid substrate material may be patterned to form an antenna coil, whereas the second conductive layer 416 disposed below the rigid substrate material 408 may be a ground plane for the antenna device 400.

The flexible coupling element 406 may include at least one flexible layer 430 and at least one third electrically conductive layer 432. The at least one flexible layer 430 may include a flexible material such as a flexible plastic, polyester, or silicon material. The at least one third electrically conductive layer 432 may include a conductive metal such as copper or a copper alloy electrically coupled to at least one of the first and second antenna elements 402, 404.

The flexible coupling element 406 is also asymmetrically positioned vertically between lateral surfaces of the first and second antenna elements 402, 404 and electrically couples the first antenna element 402 to the second antenna element 404. The flexible coupling element 406 may be asymmetrically positioned between the surfaces of the first and second antenna elements 402, 404 such that a first cavity 418 is disposed above a first surface 420 of the flexible coupling element and between upper lateral surfaces 422 of the first and second antenna elements 402, 404. The first cavity 418 may have a smaller depth than a second cavity 424, which is disposed below a second surface 426 of the flexible coupling element and between lower lateral surfaces 428 of the first and second antenna elements 402, 404. The asymmetric position of the flexible coupling element 406 may enable a feeding layer location, such as the first conductive layer 414, to improve the performance of the antenna elements, for example, for mmWave applications.

Figure 4B:
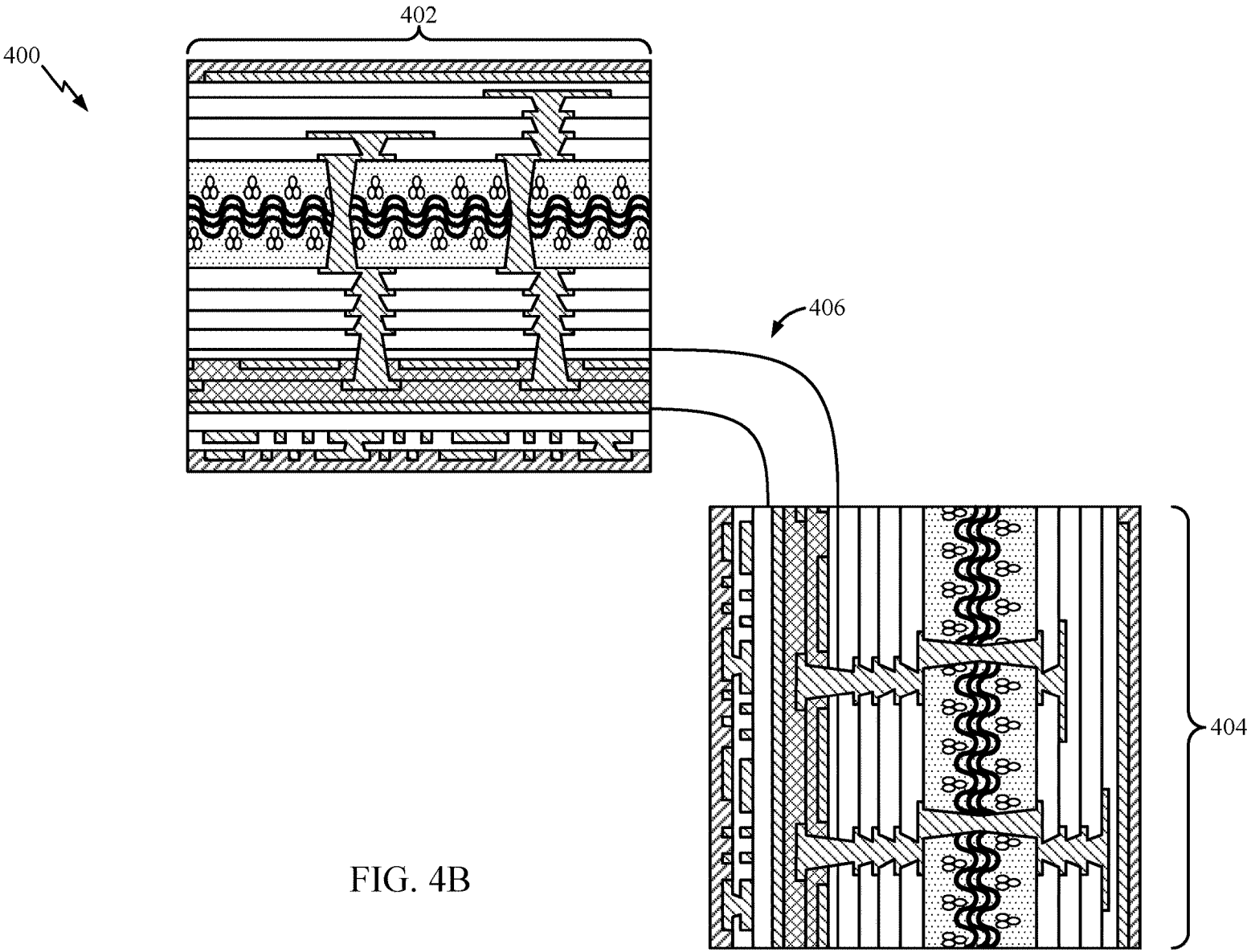
FIG. 4B is a cross-sectional view of the example antenna device of FIG. 4A where the antenna elements are oriented differently from each other, in accordance with certain aspects of the present disclosure.

The flexible coupling element 406 enables the first and second antenna elements 402, 404 to have different orientations, positions, and/or polarities. For example, FIG. 4B illustrates a cross-sectional view of the example antenna device 400, in accordance with certain aspects of the present disclosure. As shown, the first antenna element 402 may be oriented differently from the second antenna element 404. In this example, the first antenna element 402 is oriented 90 degrees with respect to the second antenna element 404. The flexible coupling element 406 may also enable the first and second antenna elements 402, 404 to conform to the shape of a wireless device, such as a UE housing or enclosure.

FIGS. 5A-5E are cross-sectional views showing example operations for fabricating the example antenna device, in accordance with certain aspects of the present disclosure. The operations may be performed by a semiconductor processing chamber, for example.

Figure 5A:
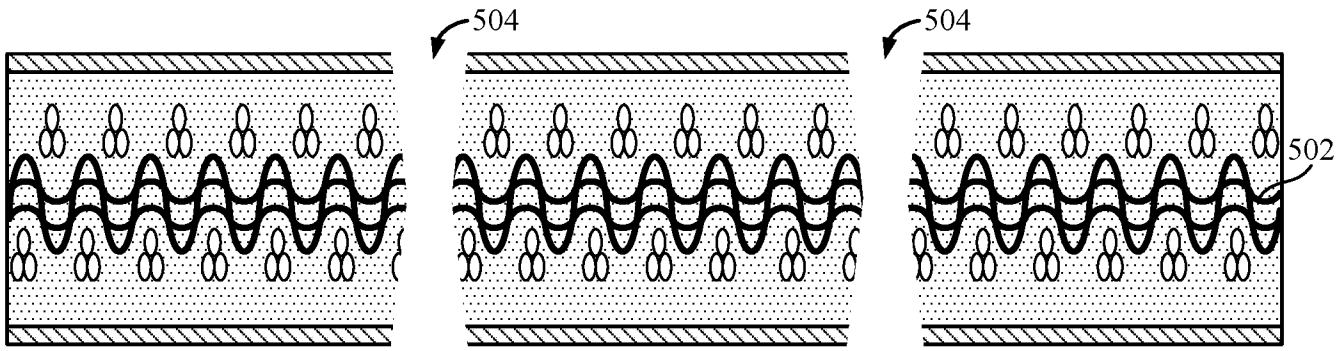
FIG. 5A is a cross-sectional view of a substrate layer, in accordance with certain aspects of the present disclosure.

Referring to FIG. 5A, a substrate layer 502 is formed. The substrate layer 502 may include a rigid core substrate, for example, the substrate material 408 shown in FIG. 4A. As shown, cavities 504 may be formed in the substrate layer 502 to receive conductive vias as further described herein.

Figure 5B:
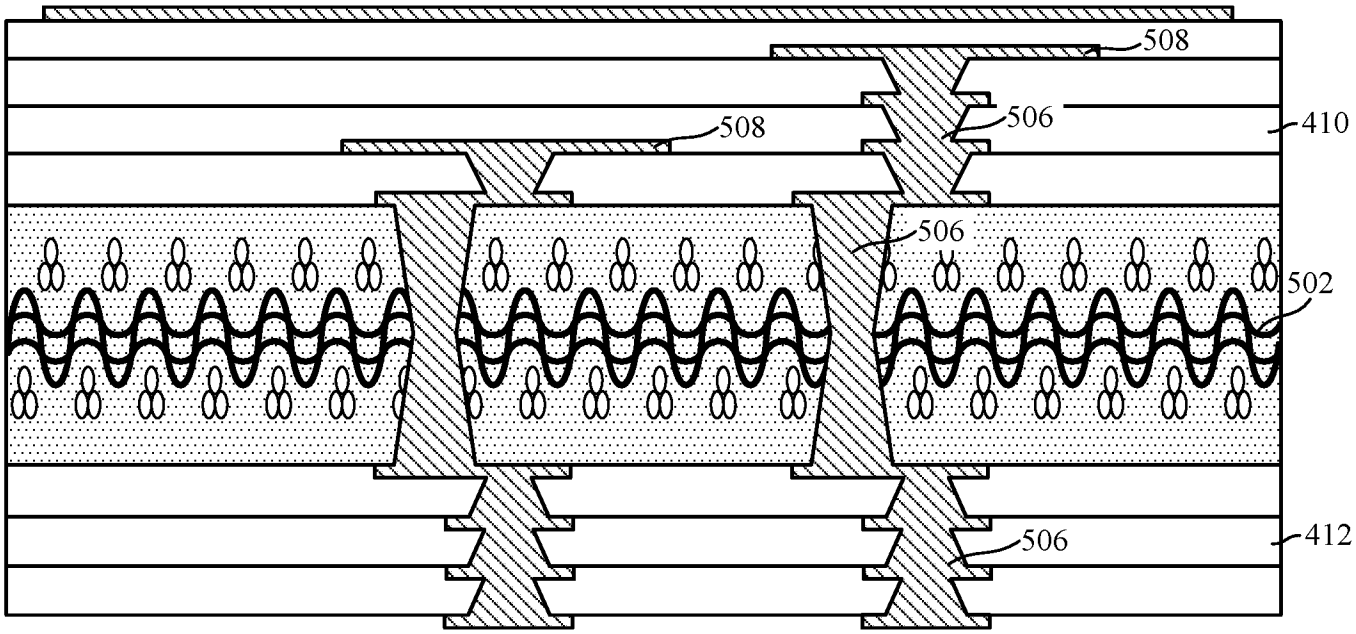
FIG. 5B is a cross-sectional view of the substrate layer with laminate layers formed thereon, in accordance with certain aspects of the present disclosure.

As illustrated in FIG. 5B, the one or more first laminate layers 410 may be formed above the substrate layer 502, and the one or more second laminate layers 412 may be formed below the substrate layer 502. Patterning of conductive via(s) 506 and trace(s) 508 may be performed on the substrate layer 502, the one or more first laminate layers 410, and the one or more second laminate layers 412.

Figure 5C:
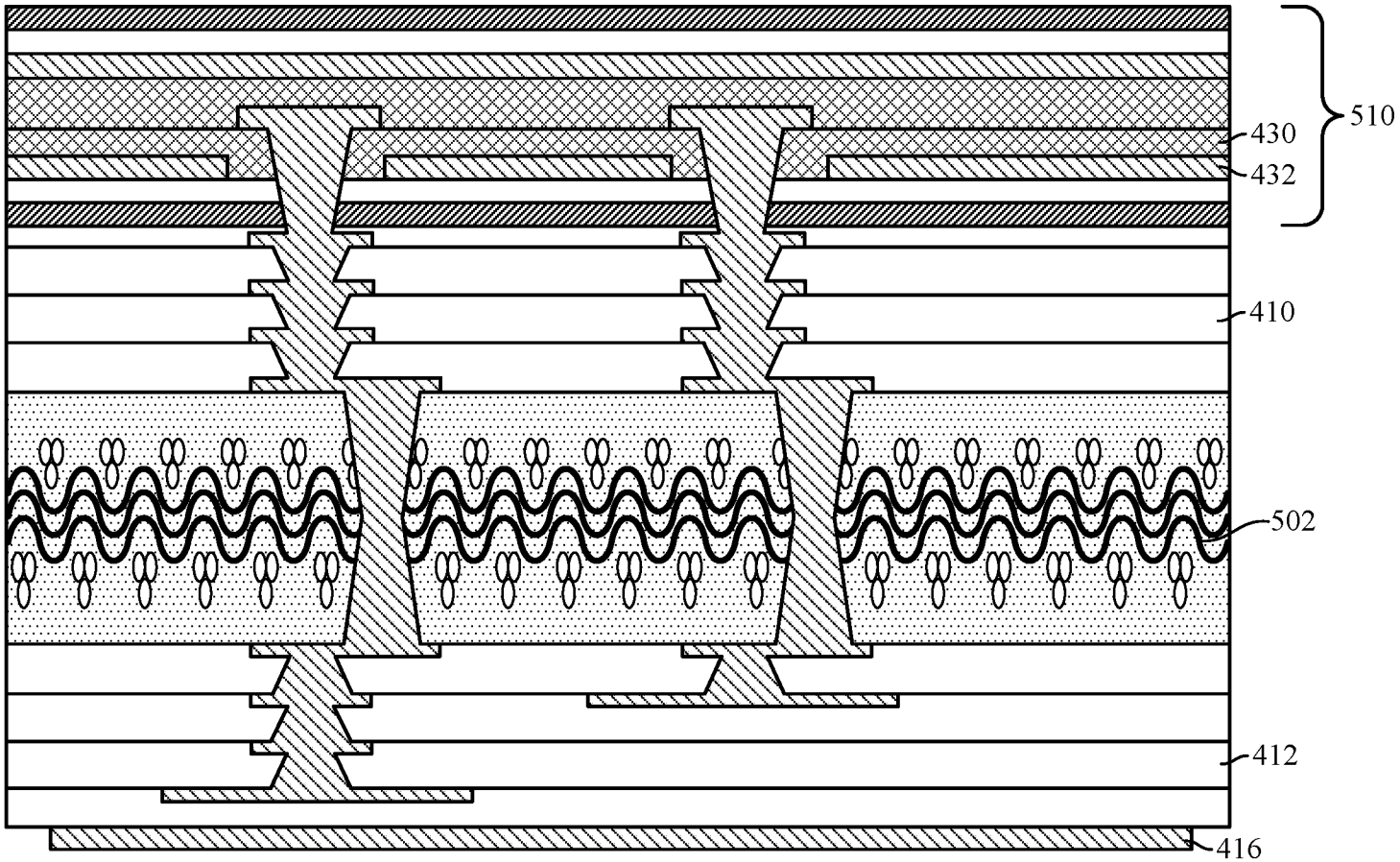
FIG. 5C is a cross-sectional view of at least one flexible coupling layer disposed above the substrate layer, in accordance with certain aspects of the present disclosure.

Referring to FIG. 5C, at least one flexible coupling layer 510 may be formed above the substrate layer 502. As shown, the at least one flexible coupling layer 510 is disposed above the one or more first laminate layers 410. The at least one flexible coupling layer 510 may include the at least one flexible layer 430 and the at least one electrically conductive layer 432 as shown in FIG. 4A. The second conductive layer 416 may be formed below the substrate layer 502.

Figure 5D:
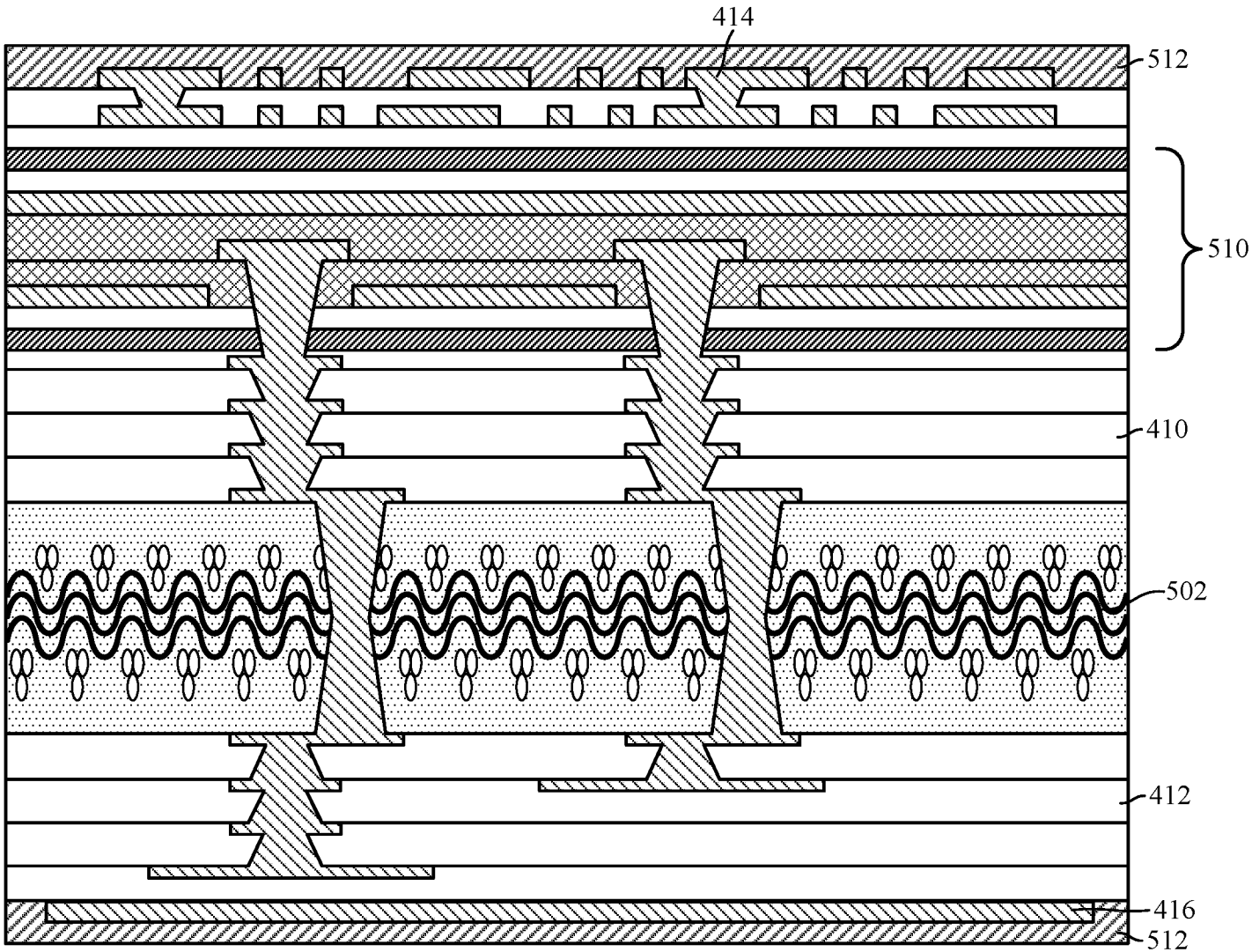
FIG. 5D is a cross-sectional view of conductive layers disposed above and below the substrate layer, in accordance with certain aspects of the present disclosure.

As shown in FIG. 5D, the first conductive layer 414 may be formed above the substrate layer 502. In this example, the first conductive layer 414 is formed above the at least one flexible coupling layer 510. As shown, layers of solder resist 512 may be formed above the first conductive layer 414 and/or below the second conductive layer 416.

Figure 5E:
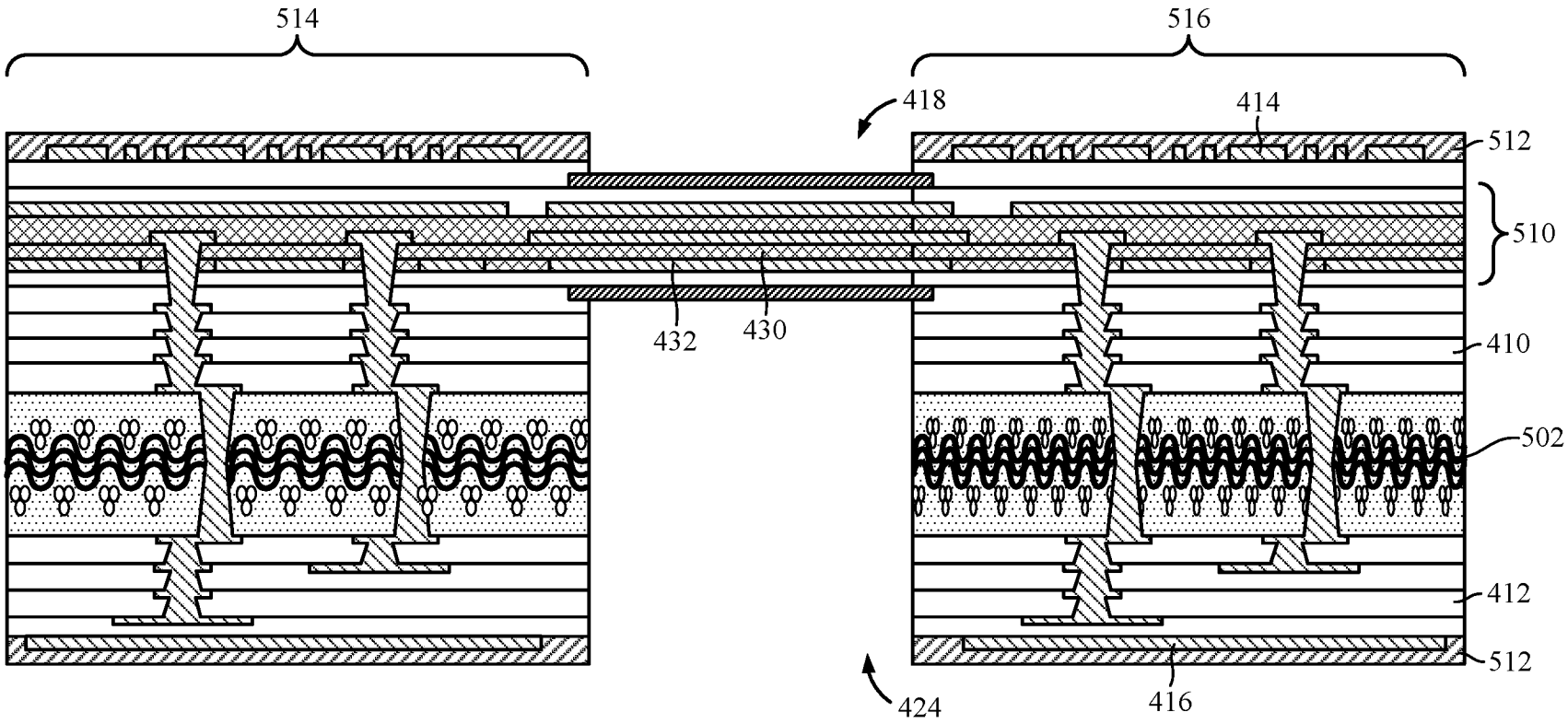
FIG. 5E is a cross-sectional view of a first cavity cut in at least one of the conductive layers and a second cavity cut in at least the substrate layer, in accordance with certain aspects of the present disclosure.

Referring to FIG. 5E, the first cavity 418 may be cut (or otherwise formed using any suitable technique) in at least the first conductive layer 414 to define a first antenna element region 514 on one side of the first cavity 418 and a second antenna element region 516 on another side of the first cavity 418. The second cavity 424 may be cut in at least the substrate layer 502 between the first antenna element region 514 and the second antenna element region 516, such that the first cavity 418 and second cavity 424 have different depths and the at least one flexible coupling layer 510 is asymmetrically positioned between surfaces of the first and second antenna element regions 514, 516. The first and second cavities may be cut using laser cutting techniques (e.g., laser drilling or laser machining), mechanical cutting techniques (e.g., ultrasonic drilling, powder blasting, or abrasive jet machining), chemical cutting techniques (e.g., wet etching), or a combination thereof.

Figure 6:
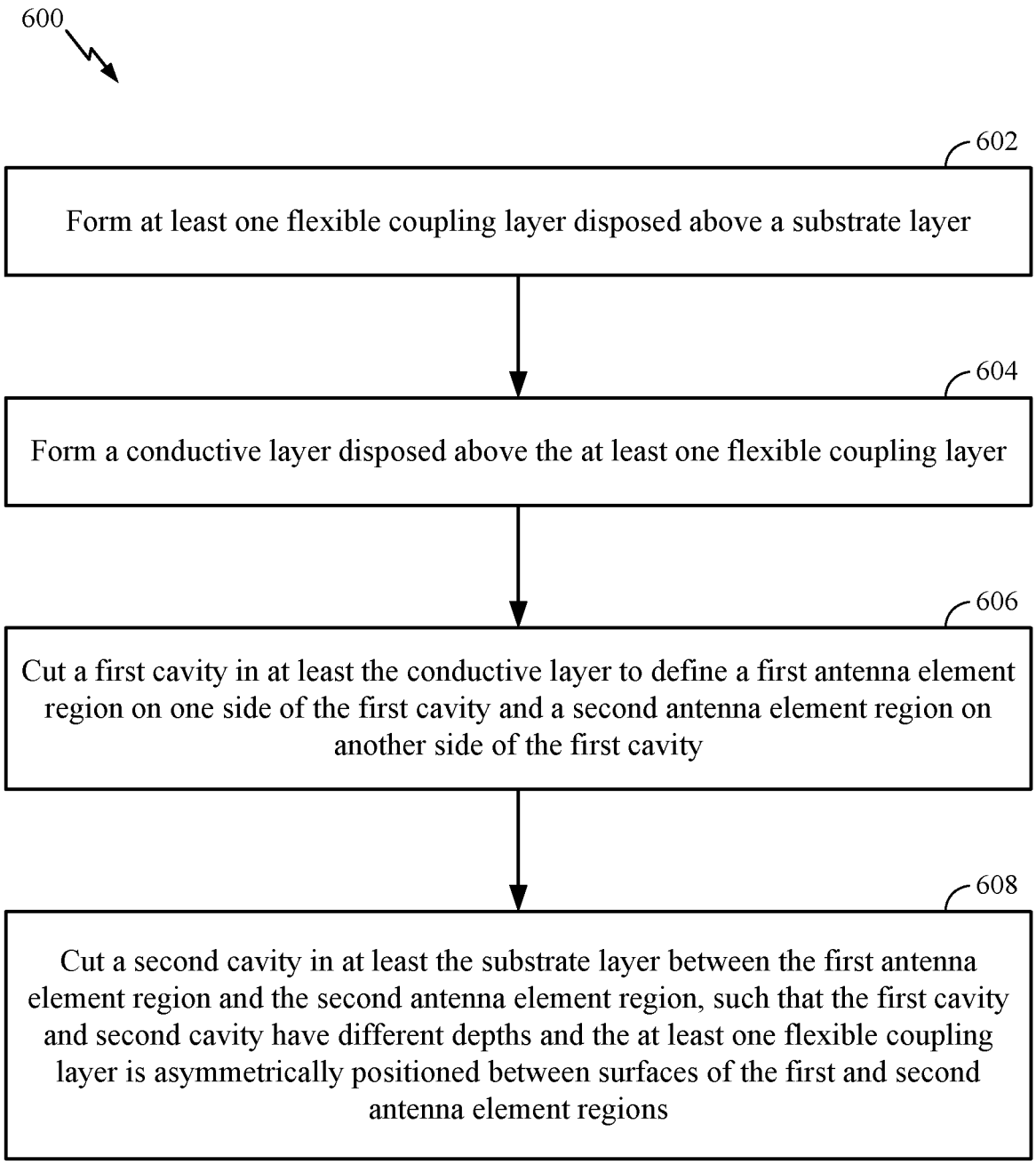
FIG. 6 is a flow diagram illustrating example operations for fabricating an antenna device, in accordance with certain aspects of the present disclosure.

FIG. 6 is a flow diagram of example operations 600 for fabricating an antenna device, in accordance with certain aspects of the present disclosure. The operations 600 may be performed by a semiconductor processing chamber, for example.

The operations 600 may begin, at block 602, by forming at least one flexible coupling layer (e.g., at least one flexible coupling layer 510) disposed above a substrate layer (e.g., substrate layer 502). At block 604, a conductive layer (e.g., first conductive layer 414) may be formed above the at least one flexible coupling layer. At block 606, a first cavity (e.g., first cavity 418) may be cut in at least the conductive layer to define a first antenna element region (e.g., first antenna element region 514) on one side of the first cavity and a second antenna element region (e.g., second antenna element region 516) on another side of the first cavity. At block 608, a second cavity (e.g., second cavity 424) may be cut in at least the substrate layer between the first antenna element region and the second antenna element region, such that the first cavity and second cavity have different depths and the at least one flexible coupling layer is asymmetrically positioned between surfaces of the first and second antenna element regions.

In certain aspects, cutting the first cavity may include cutting the first cavity to form a first surface (e.g., first surface 420) above the at least one flexible coupling layer and upper lateral surfaces (e.g., lateral surfaces 422) of the first and second antenna regions.

In certain aspects, cutting the second cavity may include cutting the second cavity to form a second surface (e.g., second surface 426) below the at least one flexible coupling layer and lower lateral surfaces (e.g., lateral surfaces 428) of the first and second antenna regions.

The substrate layer may include a rigid core substrate material. One or more first laminate layers (e.g., 410) may be disposed above the rigid core, and one or more second laminate layers (e.g., 412) may be disposed below the rigid core. Cutting the second cavity may include cutting the second cavity in the one or more first laminate layers and the one or more second laminate layers.

An additional conductive layer (e.g., second conductive layer 416) may be disposed below the one or more second laminate layers. Cutting the second cavity may include cutting the second cavity in the additional conductive layer.

The methods disclosed herein comprise one or more steps or actions for achieving the methods. The method steps and/or actions may be interchanged with one another without departing from the scope of the claims. In other words, unless a specific order of steps or actions is specified, the order and/or use of specific steps and/or actions may be modified without departing from the scope of the claims.

As used herein, a phrase referring to "at least one of" a list of items refers to any combination of those items, including single members. As an example, "at least one of: a, b, or c" is intended to cover a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, and c-c-c or any other ordering of a, b, and c).

As used herein, the term "determining" encompasses a wide variety of actions. For example, "determining" may include calculating, computing, processing, deriving, investigating, looking up (e.g., looking up in a table, a database or another data structure), ascertaining, and the like. Also, "determining" may include receiving (e.g., receiving information), accessing (e.g., accessing data in a memory) and the like. Also, "determining" may include resolving, selecting, choosing, establishing, and the like.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112(f) unless the element is expressly recited using the phrase "means for" or, in the case of a method claim, the element is recited using the phrase "step for."

The various operations of methods described above may be performed by any suitable means capable of performing the corresponding functions. The means may include various hardware component(s) and/or module(s). Generally, where there are operations illustrated in figures, those operations may have corresponding counterpart means-plus-function components with similar numbering.

It is to be understood that the claims are not limited to the precise configuration and components illustrated above. Various modifications, changes and variations may be made in the arrangement, operation and details of the methods and apparatus described above without departing from the scope of the claims.

What is claimed is:

1. A method of fabricating an antenna device, comprising:

forming a first antenna element and a second antenna element; and forming a flexible coupling element asymmetrically positioned between opposing surfaces of the first and second antenna elements and electrically coupling the first antenna element to the second antenna element, wherein forming the first and second antenna elements and the flexible coupling element comprises:

forming at least one flexible coupling layer disposed above a substrate layer;

forming a conductive layer disposed above the at least one flexible coupling layer; and after forming the conductive layer disposed above the at least one flexible coupling layer, cutting a first cavity in at least the conductive layer to define a first antenna element region on one side of the first cavity and a second antenna element region on another side of the first cavity.

2. The method of claim 1, wherein forming the first and second antenna elements and the flexible coupling element further comprises cutting a second cavity in at least the substrate layer between the first antenna element region and the second antenna element region, such that the first cavity and second cavity have different depths and the at least one flexible coupling layer is asymmetrically positioned between surfaces of the first and second antenna element regions, wherein cutting the first cavity comprises cutting the first cavity to form a first surface above the at least one flexible coupling layer and upper lateral surfaces of the first and second antenna regions.

3. The method of claim 2, wherein cutting the second cavity comprises cutting the second cavity to form a second surface below the at least one flexible coupling layer and lower lateral surfaces of the first and second antenna regions.

4. The method of claim 2, wherein the at least one flexible coupling layer is electrically coupled to the first antenna element region and the second antenna element region.

5. The method of claim 2, wherein the substrate layer comprises a rigid core, wherein one or more first laminate layers are disposed above the rigid core, and wherein one or more second laminate layers are disposed below the rigid core.

6. The method of claim 5, wherein cutting the second cavity comprises cutting the second cavity in the one or more first laminate layers and the one or more second laminate layers.

7. The method of claim 5, further comprising forming an additional conductive layer disposed below the one or more second laminate layers, wherein cutting the second cavity comprises cutting the second cavity in the additional conductive layer.

8. The method of claim 1, wherein the at least one flexible coupling layer comprises at least one flexible layer and at least one electrically conductive layer.

* * * * *